US012466449B2

(12) United States Patent
Wu

(10) Patent No.: US 12,466,449 B2
(45) Date of Patent: Nov. 11, 2025

(54) TRACK TRAVELLING DEVICE

(71) Applicant: JINGDONG TECHNOLOGY INFORMATION TECHNOLOGY CO., LTD., Beijing (CN)

(72) Inventor: Chuanbiao Wu, Beijing (CN)

(73) Assignee: JINGDONG TECHNOLOGY INFORMATION TECHNOLOGY CO., LTD., Beijing (CN)

( * ) Notice: Subject to any disclaimer, the term of this patent is extended or adjusted under 35 U.S.C. 154(b) by 760 days.

(21) Appl. No.: 17/772,050

(22) PCT Filed: Oct. 27, 2020

(86) PCT No.: PCT/CN2020/124060

§ 371 (c)(1),
(2) Date: Apr. 26, 2022

(87) PCT Pub. No.: WO2021/088685

PCT Pub. Date: May 14, 2021

(65) Prior Publication Data

US 2022/0402531 A1 Dec. 22, 2022

(30) Foreign Application Priority Data

Nov. 5, 2019 (CN) ..... 201911068297.4

(51) Int. Cl.
*B61D 15/12* (2006.01)
*B61C 9/52* (2006.01)
*B61F 1/14* (2006.01)

(52) U.S. Cl.
CPC ..... *B61D 15/12* (2013.01); *B61C 9/52* (2013.01); *B61F 1/14* (2013.01)

(58) Field of Classification Search
CPC ..... B61D 15/12; B61C 9/52; B61F 1/14
See application file for complete search history.

(56) References Cited

U.S. PATENT DOCUMENTS 2,286,456 A * 6/1942 Boettcher ..... E01B 35/04 33/523.1
5,094,004 A * 3/1992 Wooten ..... G01C 22/02 33/366.26

(Continued)

FOREIGN PATENT DOCUMENTS

CN 104653667 A * 5/2015
CN 105644572 A * 6/2016

(Continued)

OTHER PUBLICATIONS

"Communication with Supplementary European Search Report", EP Application No. 20884539.6, Sep. 12, 2023, 7 pp.

(Continued)

*Primary Examiner* — Jason C Smith
(74) *Attorney, Agent, or Firm* — Myers Bigel, P.A.

(57) ABSTRACT

The present disclosure relates to a track travelling device, comprising a vehicle body, a connection device and two groups of wheels. The two groups of wheels are disposed on two sides of the vehicle body respectively and the wheels comprise rims matched with tracks. One end of the connection device is connected to a bottom of the vehicle body and the other end of the connection device is connected to the wheels. The connection device comprises an elastic member and the elastic member is configured to be deformed under the gravity of the vehicle body to adjust distances between the rims of the two groups of wheels. Under the gravity of the vehicle body, the track travelling device of the present disclosure can closely attach the rims of the wheels to side surfaces of the tracks, thereby preventing the vehicle body from swaying side to side. Meanwhile, the connection device comprises the elastic member for adaption to a change of a track gauge.

19 Claims, 4 Drawing Sheets

(56) References Cited

U.S. PATENT DOCUMENTS

| | | | | |
|---|---|---|---|---|
| 11,639,187 | B2 * | 5/2023 | Zhao | B61F 9/00 104/118 |
| 2022/0402531 | A1 * | 12/2022 | Wu | B61F 1/14 |

FOREIGN PATENT DOCUMENTS

| | | | | | |
|---|---|---|---|---|---|
| CN | 205890391 | U | * | 1/2017 | |
| CN | 106740965 | A | | 5/2017 | |
| CN | 207163471 | U | | 3/2018 | |
| CN | 109017841 | A | | 12/2018 | |
| CN | 208615950 | U | * | 3/2019 | B61D 15/00 |
| CN | 208993694 | U | * | 6/2019 | |
| CN | 209038450 | U | | 6/2019 | |
| CN | 110281958 | A | * | 9/2019 | B61B 3/00 |
| CN | 110758438 | A | * | 2/2020 | B61C 9/52 |
| CN | 110758438 | B | * | 1/2021 | B61C 9/52 |
| DE | 202011051852 | U1 | * | 1/2012 | B61K 9/08 |
| EP | 2347941 | A1 | | 7/2011 | |
| ES | 2691145 | A1 | | 11/2018 | |
| KR | 100454425 | B1 | * | 10/2004 | |
| WO | 2015004998 | A1 | | 1/2015 | |
| WO | WO-2019205060 | A1 | * | 10/2019 | |

OTHER PUBLICATIONS

"English language translation of International Search Report and Written Opinion of the International Searching Authority", International Application No. PCT/CN2020/124060, Jan. 27, 2021, 7 pp.
"First Office Action and English language translation", CN Application No. 201911068297.4, Jun. 9, 2020, 14 pp.

* cited by examiner

TRACK TRAVELLING DEVICE

CROSS-REFERENCE TO RELATED APPLICATIONS

The present application is a U.S. National Stage Application under 35 U.S.C. § 371 of International Patent Application No. PCT/CN2020/124060, filed on Oct. 27, 2020, which is based on and claims priority to Chinese Patent Application No. 201911068297.4 filed on Nov. 5, 2019, the disclosures of both of which are incorporated herein by reference in their entireties.

FIELD OF THE INVENTION

The present disclosure relates to a technical field of track travelling machinery, and particularly to a track travelling device.

BACKGROUND OF THE INVENTION

In recent years, the railways are increasingly longer with the rapid development of the railway industry, and the workload of the patrol inspection of the railway tracks continuously increases. The traditional patrol inspection mode is that workers carry patrol devices manually for foot patrol inspections, which takes a long inspection time and requires many inspection personnel, while a single measurement has little data, large errors and a low efficiency. Moreover, the traditional patrol inspection mode requires the workers to walk on the tracks, which poses a great potential safety hazard.

At present, some companies have researched and developed the intelligent patrol inspection devices on the railways or subways. The intelligent patrol inspection devices are mounted with wheels, wherein some of the intelligent patrol inspection devices need to be pushed manually, and some can automatically walk by carrying batteries. The normal railways, subways and high-speed railways have different track gauges. Although the standard track gauge is 1435 mm, the actual track gauge is deviated from the standard track gauge. At present, the wheel gauges of the existing patrol inspection devices are all fixed and inconvenient to be adjusted. Some wheel gauges are too small, and the vehicle body will sway from side to side during travelling. In order to prevent the vehicle body from swaying from side to side, some patrol inspection devices are mounted with track clamping devices. However, the railway conditions are complicated with various intersections and turnouts, and the passability of the patrol inspection devices will be deteriorated after the track clamping devices are mounted.

It should be noted that the information disclosed in the background section of the present disclosure is only intended to improve the understanding of the general background of the present disclosure, and should not be deemed as an admission or any form of suggestion that the information constitutes the prior arts already known to those skilled in the art.

SUMMARY OF THE INVENTION

The embodiments of the present disclosure propose a track travelling device, comprising:

a vehicle body;

two groups of wheels disposed on two sides of the vehicle body respectively, the wheels being provided with rims; and a connection device, one end of which is connected to a bottom of the vehicle body and the other end of which is connected to the wheels, the connection device comprising an elastic member, the elastic member is configured to be deformed under the gravity of the vehicle body to closely attach the rims of the two groups of wheels to side surfaces of tracks.

In some embodiments, a direction of a force applied by the elastic member to the wheels is a direction extending from the vehicle body toward a direction away from a symmetry plane between two of the tracks and inclined relative to the symmetry plane.

In some embodiments, an included angle between the direction of the force and the symmetry plane is 30° to 60°.

In some embodiments, the directions of the forces applied to the corresponding wheels by two of the elastic members corresponding to two of the wheels arranged symmetrically with respect to the symmetry plane are symmetrical with respect to the symmetry plane.

In some embodiments, each of the wheels is connected to the vehicle body through a separate connection device.

In some embodiments, each separate connection device comprises a plurality of the elastic members which are arranged in parallel.

In some embodiments, the connection device further comprises a first connection plate connected to the wheels and a second connection plate connected to the bottom of the vehicle body, the elastic member is disposed between the first connection plate and the second connection plate.

In some embodiments, the connection device further comprises a guide device configured to guide a deformation direction of the elastic member.

In some embodiments, the guide device comprises a guide shaft, the elastic member sleeves an outer periphery of the guide shaft, and the guide shaft is arranged inclinedly with respect to a symmetry plane between two of the tracks.

In some embodiments, a first end of the guide shaft is connected to the first connection plate, the second connection plate is provided with a slideway, and a second end of the guide shaft is inserted into the slideway.

In some embodiments, the guide device further comprises a sleeve disposed in the slideway, and the second end of the guide shaft is inserted into the sleeve.

In some embodiments, an end of the slideway away from the first connection plate is provided with an opening, and the guide device further comprises a flexible pad which is mounted at the second end of the guide shaft.

In some embodiments, the second connection plate is provided with an accommodation cavity communicated with the slideway.

In some embodiments, the first connection plate comprises a vertical plate disposed vertically and a horizontal plate disposed horizontally, the vertical plate is connected to the horizontal plate, the vertical plate is connected to the wheels, and the horizontal plate is connected to the guide shaft.

In some embodiments, the horizontal plate comprises a mounting portion, which has a surface parallel to an end face of the guide shaft.

In some embodiments, the track travelling device further comprises a driving device, which is mounted on the first connection plate, drivingly connected to the wheels, and disposed in parallel with the track.

In some embodiments, the track travelling device further comprises an anti-collision bar mounted on a front side and/or a rear side of the vehicle body.

In some embodiments, the track travelling device further comprises a sensor mounted on the vehicle body to detect a distance between an obstacle and the vehicle body.

In some embodiments, the track travelling device further comprises a monitoring device mounted on the vehicle body to monitor a surrounding environment of the vehicle body.

In some embodiments, the track travelling device further comprises a detection device mounted on the vehicle body to detect connection states of components on the vehicle body, the connection device and the wheels.

Based on the above technical solutions, in the embodiments of the present disclosure, one end of the connection device is connected to the bottom of the vehicle body, and under the gravity of the vehicle body, the rims of the wheels are closely attached to the side surfaces of the tracks, thereby preventing the vehicle body from swaying side to side and improving the stability of the track travelling device during travelling. Meanwhile, the connection device comprises the elastic member, the elastic member is deformable to adjust relative positions of the wheels and the vehicle body, thereby adjusting distances between the two groups of wheels on the left and right sides, and improving an adaptability to a change of a track gauge.

Other features and advantages of the present disclosure will become clear from the following detailed description of the exemplary embodiments of the present disclosure made with reference to the drawings.

BRIEF DESCRIPTION OF THE DRAWINGS

In order to more clearly illustrate the technical solutions in the embodiments of the present disclosure or in the prior arts, the drawings to be used in the description of the embodiments or the prior arts will be briefly introduced below. Obviously, the drawings used in the following description only illustrate the embodiments of the present disclosure, and other drawings can be obtained by those of ordinary skills in the art according to these drawings without paying any creative labor.

DETAILED DESCRIPTION OF THE EMBODIMENTS

Figure 1:
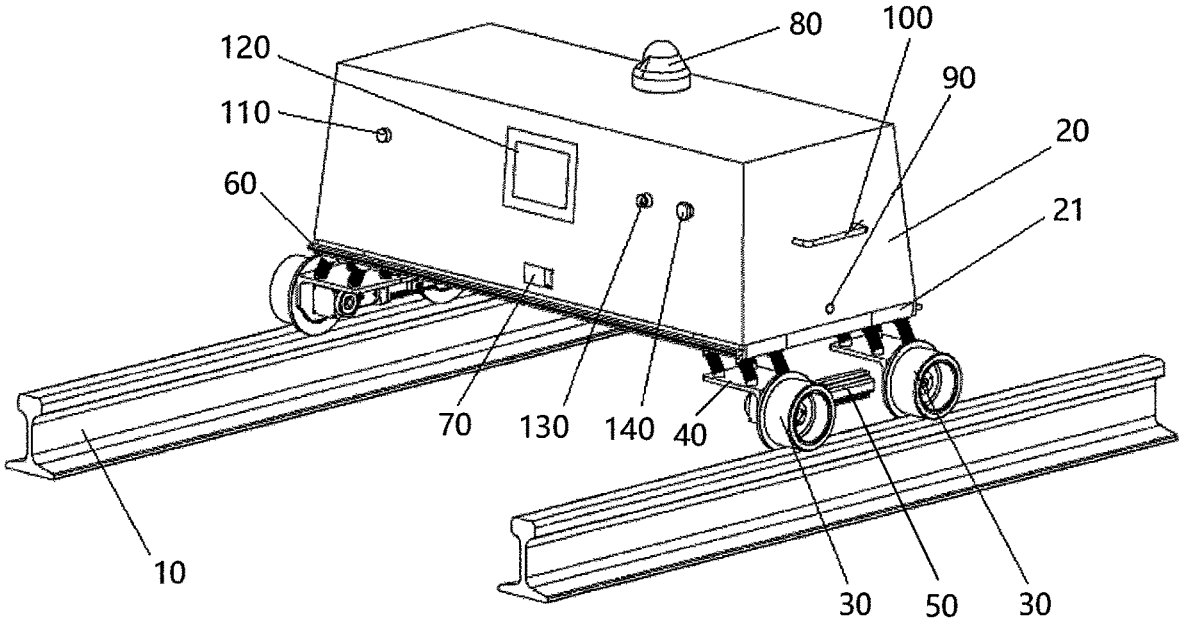
FIG. 1 is a structural diagram of a track travelling device according to an embodiment of the present disclosure.

The technical solutions in the embodiments of the present disclosure will be described clearly and completely with reference to the drawings in the embodiments of the present disclosure. Obviously, those described are only a part, rather than all, of the embodiments of the present disclosure. Based on the embodiments of the present disclosure, any other embodiment obtained by those of ordinary skills in the art without paying any creative labor should fall within the protection scope of the present disclosure.

In the description of the present disclosure, it should be understood that orientational or positional relationships indicated by the terms 'central', 'lateral', 'longitudinal', 'front', 'rear', 'left', 'right', 'upper', 'lower', 'vertical', 'horizontal', 'top', 'bottom', 'inner' and 'outer' are based on the drawings, only for the convenience of describing the present disclosure and simplifying the description, rather than indicating or implying that a referred device or element must have a particular orientation, or be constructed and operated in a particular orientation, and they should not be construed as limitations to the protection scope of the present disclosure.

Referring to FIGS. 1 to 7, a track travelling device comprises a vehicle body 20, a connection device 40, and two groups of wheels 30, wherein the two groups of wheels 30 are disposed on left and right sides of the vehicle body 20 respectively, the wheels 30 are provided with rims 31; one end of the connection device 40 is connected to a bottom of the vehicle body 20, and the other end of the connection device 40 is connected to the wheels 30; the connection device 40 comprises an elastic members 41 and the elastic members 41 is configured to be deformed by the gravity of the vehicle body 20 to closely attach the rims of the two groups of wheels 30 to side surfaces of tracks 10.

In the above embodiment, one end of the connection device 40 is connected to the bottom of the vehicle body 20, and under the gravity of the vehicle body 20, the rims 31 of the wheels 30 are closely attached to the side surfaces of the tracks 10, thereby preventing the vehicle body 20 from swaying side to side and improving the stability of the track travelling device during travelling. Meanwhile, the connection device 40 comprises the elastic member 41 and the elastic member 41 is deformable to adjust relative positions of the wheels 30 and the vehicle body 20, thereby adjusting distances between the two groups of wheels 30 on the left and right sides, and improving an adaptability to a change of a track gauge.

In the related arts, the track travelling device comprises a track clamping device for clamping the wheels and the tracks. Although the track clamping device can keep a travelling stability of the track travelling device to a certain extent, it cannot adapt to the change of the track gauge, and when the track gauge changes, the track clamping device will be failed, or disenable the track travelling device to pass normally. In the embodiments of the present disclosure, the track travelling device automatically adjusts the distances between the two groups of wheels 30 on the left and right sides through the deformation of the elastic member 41, so as to adapt to the change of the track gauge and reduce the influence on the passability of the track travelling device.

The vehicle body 20 wholly has a cubic shape, wherein a top surface and a bottom surface both have a rectangular shape, four side surfaces have a trapezoidal shape, and an area of the top surface is smaller than that of the bottom surface. In other embodiments, the vehicle body 20 may also have other shapes such as a cube, a triangular prism, etc.

The vehicle body 20 comprises a vehicle main body and a bottom plate 21, the bottom plate 21 is disposed at a bottom of the vehicle main body and the bottom plate 21 is configured to support the vehicle main body.

One end of the wheel 30 close to an inner side of the track 10 is provided with a rim 31, the rim 31 extends outward in a radial direction of the wheel 30. The wheel 30 further comprises a protective cover plate 32 for protecting internal parts of the wheel 30.

A direction of a force applied by the elastic member 41 to the wheel 30 is a direction extending from the vehicle body 20 toward a direction away from a symmetry plane between two tracks 10 and inclined relative to the symmetry plane. The symmetry plane between two tracks 10 is a vertical plane parallel to an extension direction of the tracks. The force applied by the elastic member 41 to the wheel 30 in the inclined direction can be divided into a vertical downward component force, and a horizontal component force pointing from an inner side to an outer side of the track 10. The vertical downward component force can ensure that an outer peripheral surface of the wheel 30 is in contact with a top surface of the track 10, while the horizontal component force pointing from the inner side to the outer side of the track 10 can closely attach the rim 31 to an inner side surface of the track 10, so as to ensure the travelling stability of the track travelling device and prevent the vehicle body 20 from swaying side to side, while adapting to the change of the track gauge.

An included angle between the direction of the force applied by the elastic member 41 to the wheel 30 and the symmetry plane is 30° to 60°, such as 30°, 45° or 60°.

As illustrated in FIG. 1, the track travelling device comprises four wheels 30, wherein the left and right sides of the vehicle body 20 are each provided with two wheels 30, and the wheels 30 on the two sides are arranged symmetrically with respect to the symmetry plane. The number of the wheels 30 is the same as that of the connection devices 40, and each of the wheels 30 is connected to the vehicle body 20 through an separate connection device 40, which is beneficial to ensure effective contact between at least a part of the wheels 30 and the track 10.

In other embodiments, the total number of the wheels 30 may also be two, three or more. The number of the wheels 30 in each group may be one or more, and the numbers of the wheels 30 in different groups may be the same or different.

Each the separate connection device 40 comprises a plurality of the elastic members 41 which are arranged in parallel. As illustrated in FIG. 1, each the separate connection device 40 comprises four elastic members 41. In other embodiments, each of the separate connection devices 40 may comprise one, two or more elastic members 41.

The directions of the forces applied to corresponding wheels 30 by two of the elastic members 41 corresponding to two of the wheels 30 arranged symmetrically with respect to the symmetry plane are symmetrical with respect to the symmetry plane. In this way, the wheels 30 on the two sides can be outwardly and closely attached to the side surfaces of the tracks 10 respectively.

Figure 2:
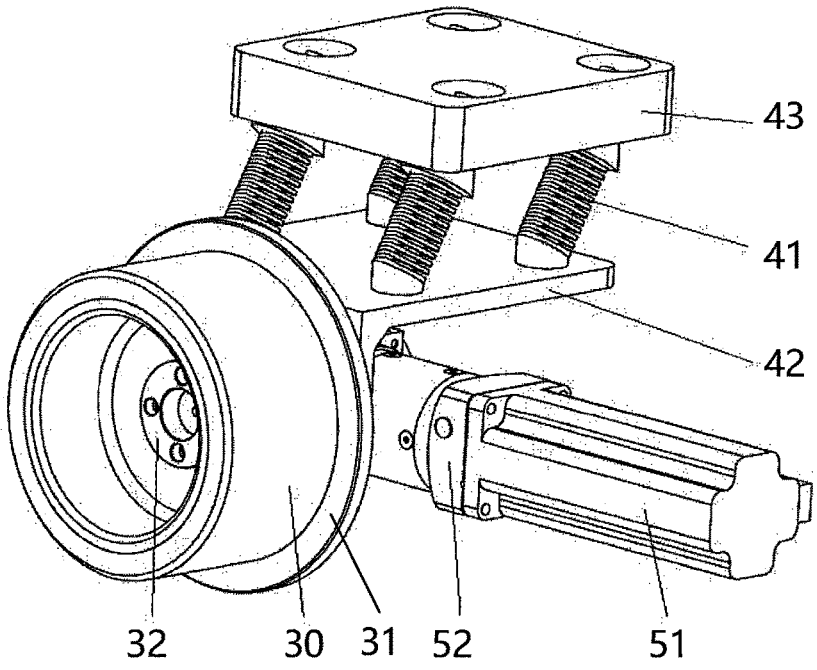
FIG. 2 is a structural diagram of connections between a wheel, a connection device and a driving device in a track travelling device according to an embodiment of the present disclosure.
Figure 5:
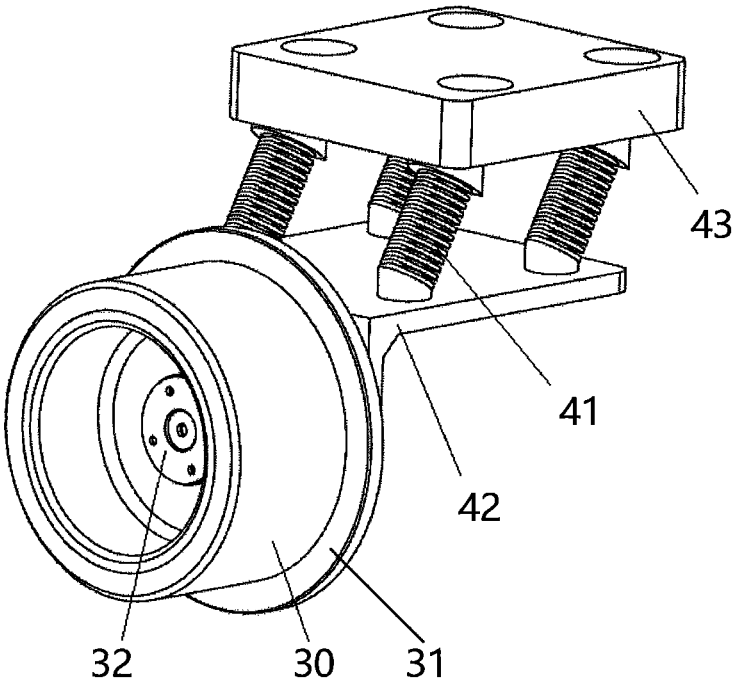
FIG. 5 is a structural diagram of a connection between another wheel and a connection device in a track travelling device according to a embodiment of the present disclosure.

As illustrated in FIGS. 2 and 5, the connection device 40 further comprises a first connection plate 42 connected to the wheels 30, and a second connection plate 43 connected to the bottom of the vehicle body 20, with the elastic member 41 disposed between the first connection plate 42 and the second connection plate 43.

The second connection plate 43 is connected to the bottom plate 21 of the vehicle body 20, or integrally formed with the bottom plate 21.

The connection device 40 further comprises a guide device and the guide device is configured to guide a deformation direction of the elastic member 41. By disposing the guide device, the elastic member 41 can be supported and guided, and the pressing effect on the wheel 30 can be improved.

There are many options for the specific structure of the guide device. As illustrated in FIGS. 2 to 7, the guide device comprises a guide shaft 44, the elastic member 41 sleeves an outer periphery of the guide shaft 44, and the guide shaft 44 is arranged inclinedly with respect to a symmetry plane between two tracks 10. The guide shaft 44 is inclined in a direction away from the symmetry plane from the vehicle body 20, i.e., inclined toward the outer side of the track 10.

Figure 4:
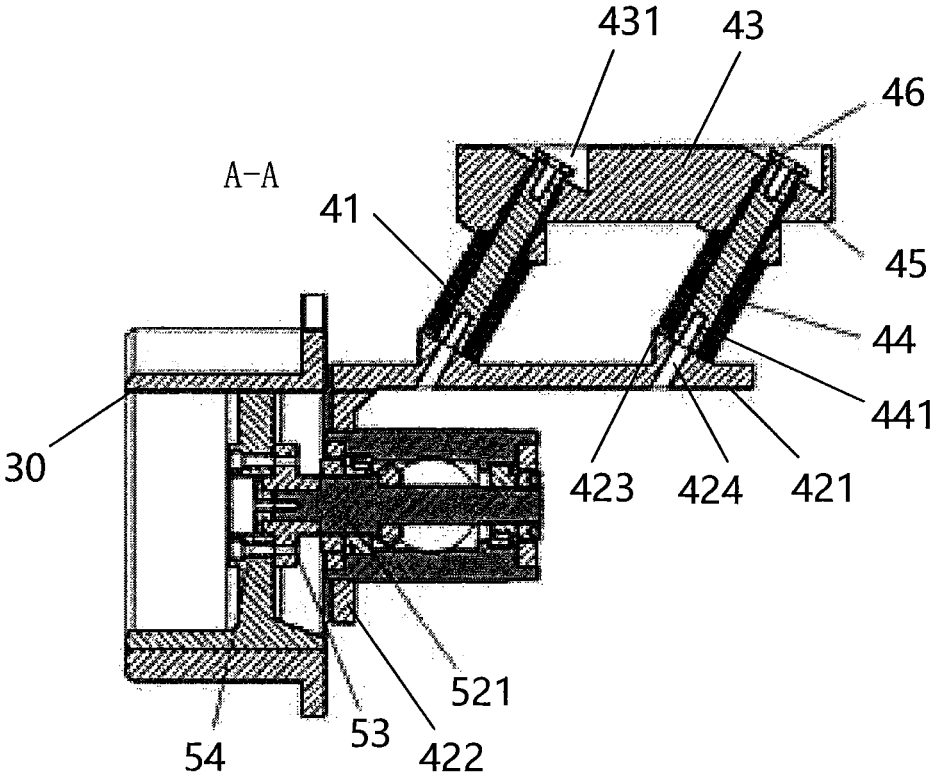
FIG. 4 is a cross-sectional view of cross-section A-A in FIG. 3.

As illustrated in FIG. 4, a first end of the guide shaft 44 is connected to the first connection plate 42, the second connection plate 43 is provided with a slideway, and a second end of the guide shaft 44 is inserted into the slideway.

The guide device further comprises a sleeve 45 disposed in the slideway, and the second end of the guide shaft 44 is inserted into the sleeve 45. By disposing the sleeve 45, a smooth sliding of the guide shaft 44 in the sleeve 45 can be effectively ensured.

Further, an end of the slideway away from the first connection plate 42 is provided with an opening, that is, both ends of the slideway are opened. The guide device further comprises a flexible pad 46 which is mounted at the second end of the guide shaft 44. By disposing the flexible pad 46, the guide shaft 44 can be prevented from colliding with other parts after passing through the slideway, so that the guide shaft 44 can be effectively protected.

The second connection plate 43 is provided with an accommodation cavity 431 and the accommodation cavity 431 is communicated with the slideway. By disposing the accommodation cavity 431, it is possible to avoid the guide shaft 44 from protruding out of the second connection plate 43 and prevent the guide shaft 44 from colliding with the vehicle body 20. The accommodation cavity 431 has a triangular cross-section, which ensures that an upper surface of the second connection plate 43 is still horizontal. The second connection plate 43 is provided with a groove, an inner space of which is the accommodation cavity 431.

The first connection plate 42 comprises a vertical plate 422 disposed vertically and a horizontal plate 421 disposed horizontally. The horizontal plate 421 is parallel to the second connection plate 43, the vertical plate 422 is connected to the horizontal plate 421, the vertical plate 422 is connected to the wheel 30, and the horizontal plate 421 is connected to the guide shaft 44.

The horizontal plate 421 comprises a mounting portion 423, which has a surface parallel to an end face of the guide shaft 44. The mounting portion 423 has a triangular cross-section. By disposing the mounting portion 423, it is possible to avoid the connection between the guide shaft 44 and the horizontal plate 421.

The horizontal plate 421 is provided with a first connection hole 424. The first end of the guide shaft 44 is provided with a second connecting hole 441. A connection member is inserted into the first connecting hole 424 and the second connecting hole 441 to realize the connection between the horizontal plate 421 and the guide shaft 44.

The track travelling device further comprises a driving device 50, the driving device 50 is mounted on the first connection plate 42 and drivingly connected to the wheel 30. The driving device 50 is disposed in parallel with the track 10. This arrangement can prevent the driving device 50 from occupying a space between two tracks 10.

In each group of wheels 30, some of the wheels 30 are driving wheels, and some of the wheels 30 are driven wheels, and the driving device 50 is drivingly connected to the driving wheels.

Figure 3:
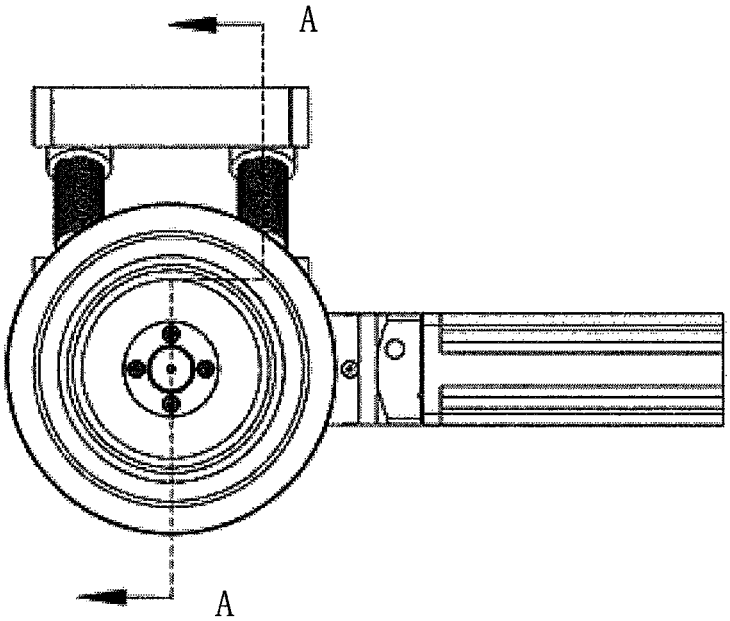
FIG. 3 is a top view of FIG. 2.

FIGS. 2, 3 and 4 illustrate structural diagrams of connections between the wheel 30 acting as a driving wheel, the connection device 40 and the driving device 50, wherein the driving device 50 comprises a motor 51 and a speed reducer 52. An output shaft 521 of the speed reducer 52 is connected to a connection flange 53, and a first pressing plate 54 is disposed at an outer side of the connection flange 53.

Figure 6:
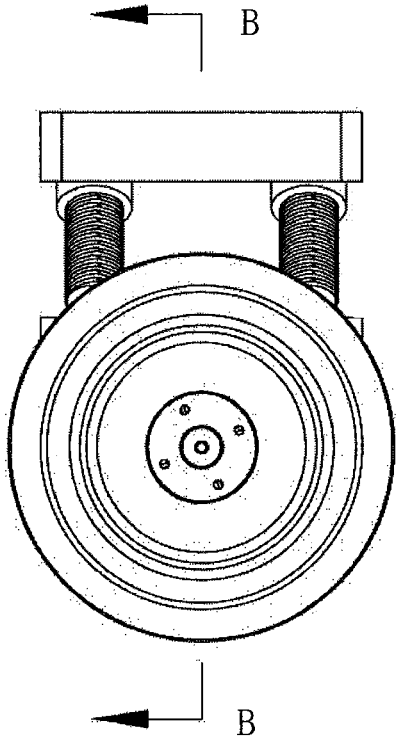
FIG. 6 is a top view of FIG. 5.
Figure 7:
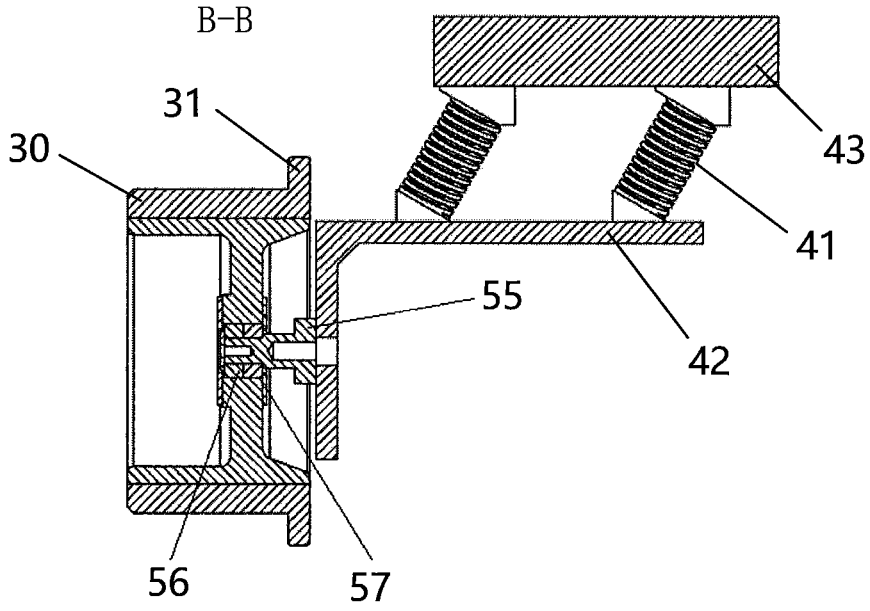
FIG. 7 is a cross-sectional view of cross-section B-B in FIG. 6.

FIGS. 5, 6 and 7 illustrate structural diagrams of a connection between the wheel 30 acting as a driven wheel and the connection device 40, wherein the first connection plate 42 of the connection device 40 is connected to a rotation shaft 55, the rotation shaft 55 is connected to the wheel 30 through a bearing 56, the outer side of the wheel 30 is provided with the protective cover plate 32, and the inner side of the wheel 30 is provided with a second pressing plate 57.

All the wheels 30 may be driving wheels or all the wheels 30 may be driven wheels. The track travelling device further comprises a driving device which drives the vehicle body 20 to move.

The track travelling device further comprises an anti-collision bar 60 mounted on a front side and/or a rear side of the vehicle body 20 to prevent the vehicle body 20 from being collided by external forces and effectively protect the vehicle body 20.

The track travelling device further comprises a sensor 70 mounted on the vehicle body 20 to detect a distance between an obstacle and the vehicle body 20. When the distance between the obstacle ahead and the vehicle body 20 is less than a preset value, the sensor 70 may send an alarm signal to a controller disposed in the vehicle body 20, and the controller may send a signal indicating to stop the operation of the driving device 50, so as to make the track travelling device stop travelling and avoid a collision with the obstacle.

The sensor 70 may be a laser sensor, so that the detection is more sensitive and rapid.

The track travelling device further comprises a monitoring device 80 and the monitoring device 80 is mounted on the vehicle body 20 to monitor a surrounding environment of the vehicle body 20. The monitoring device 80 may detect whether there is any person or domestic animal around the vehicle body 20, avoid a collision between the track travelling device and the person or the domestic animal, avoid safety accidents and improve the travelling safety.

The track travelling device further comprises a detection device 90 and the detection device 90 is mounted on the vehicle body 20 to detect connection states of the components on the vehicle body 20, the connection device 40 and the wheels 30. By disposing the detection device 90, the connection state of the components can be detected and monitored in real time, and safety accidents caused by connection failures of the components can be avoided.

The vehicle body 20 may be further provided with a handrail 100, an indicator light 110, a display screen 120, a start switch 130 and an emergency stop button 140, wherein the handrail 100 facilitates a consignment of the track travelling device, the indicator light 110 indicates whether the track travelling device is in a travelling state, the display screen 120 displays various data and parameters related to operation, the start switch 130 turns on the track travelling device, and in case of emergencies, the emergency stop button 140 can be operated to realize emergency braking.

The vehicle body 20 may also be provided with a power supply device, a driving control device, a communication device and a data processing device, wherein the power supply device is configured to supply electric power for the vehicle body 20 to walk, the driving control device is configured to control start and stop of the driving device 50, the communication device is configured to be communicated with signals of an external control end to send a travelling state and related data of the track travelling device to the external control end or receive an instruction sent by the external control terminal, and the data processing device is configured to process measurement data of monitoring components such as the sensor 70, the monitoring device 80 and the detection device 90 so that the controller can issue a corresponding control instruction.

The track travelling device in the embodiments of the present disclosure can be tightly pressed against the tracks by its own weight, and suitable elastic members may be selected for adjustment and adaption to a variation range of different track gauges. The track travelling device will not sway from side to side during travelling, which is convenient for the detection, and an intelligent patrol inspection can be achieved without requiring the personnel to get off the vehicle. Therefore, the track travelling device has a high passability and is suitable for various track scenes.

Finally, it should be noted that the above embodiments are only used for illustrations of the technical solutions of the present disclosure, rather than limitations thereto. Although the present disclosure is described in detail with reference to the preferred embodiments, those of ordinary skills in the art should understand that the specific embodiments of the present disclosure can be modified or some technical features can be equivalently replaced without deviating from the principle of the present disclosure, and these modifications and equivalent replacements should fall within in the scope of the technical solutions claimed in the present disclosure.

The invention claimed is:

1. A track travelling device, comprising:

a vehicle body;

two groups of wheels disposed on two sides of the vehicle body respectively, each of the wheels comprising a rim configured to abut against a track; and a connection device comprising an elastic member, wherein the elastic member is located below the vehicle body, an upper end of the elastic member is connected to a bottom of the vehicle body, a lower end of the elastic member is connected to the wheels, and the lower end of the elastic member connected to the wheels is far away from a symmetry plane between two of the tracks relative to the upper end of the elastic member connected to the bottom of the vehicle body, such that the elastic member is configured to be deformed under the gravity of the vehicle body to adjust distances between the rims of the two groups of wheels, and a direction of a force applied by the elastic member to the wheels is a direction extending from the vehicle body toward a direction away from the symmetry plane between the two of the tracks and inclined relative to the symmetry plane.

2. The track travelling device according to claim 1, wherein an included angle between the direction of the force and the symmetry plane is 30° to 60°.

3. The track travelling device according to claim 1, wherein the directions of the forces applied to the corresponding wheels by two of the elastic members corresponding to two of the wheels arranged symmetrically with respect to the symmetry plane are symmetrical with respect to the symmetry plane.

4. The track travelling device according to claim 1, wherein each of the wheels is connected to the vehicle body through a separate connection device.

5. The track travelling device according to claim 1, wherein each separate connection device comprises a plurality of the elastic members which are arranged in parallel.

6. The track travelling device according to claim 1, wherein the connection device further comprises a first connection plate connected to the wheels and a second connection plate connected to the bottom of the vehicle body, the elastic member is disposed between the first connection plate and the second connection plate.

7. The track travelling device according to claim 6, wherein the connection device further comprises a guide device configured to guide a deformation of the elastic member.

8. The track travelling device according to claim 7, wherein the guide device comprises a guide shaft, the elastic member sleeves an outer periphery of the guide shaft, and the guide shaft is arranged inclinedly with respect to a symmetry plane between two of the tracks.

9. The track travelling device according to claim 8, wherein a first end of the guide shaft is connected to the first connection plate, the second connection plate is provided with a slideway, and a second end of the guide shaft is inserted into the slideway.

10. The track travelling device according to claim 9, wherein the guide device further comprises a sleeve disposed in the slideway, and the second end of the guide shaft is inserted into the sleeve.

11. The track travelling device according to claim 9, wherein an end of the slideway away from the first connection plate is provided with an opening, and the guide device further comprises a flexible pad which is mounted at the second end of the guide shaft.

12. The track travelling device according to claim 9, wherein the second connection plate is provided with an accommodation cavity communicated with the slideway.

13. The track travelling device according to claim 8, wherein the first connection plate comprises a vertical plate disposed vertically and a horizontal plate disposed horizontally, the vertical plate is connected to the horizontal plate, the vertical plate is connected to the wheels, and the horizontal plate is connected to the guide shaft.

14. The track travelling device according to claim 13, wherein the horizontal plate comprises a mounting portion, which has a surface parallel to an end face of the guide shaft.

15. The track travelling device according to claim 6, further comprising a driving device, which is mounted on the first connection plate, drivingly connected to the wheels, and disposed in parallel with the track.

16. The track travelling device according to claim 1, further comprising an anti-collision bar mounted on a front side and/or a rear side of the vehicle body.

17. The track travelling device according to claim 1, further comprising a sensor mounted on the vehicle body to detect a distance between an obstacle and the vehicle body.

18. The track travelling device according to claim 1, further comprising a monitoring device mounted on the vehicle body to monitor a surrounding environment of the vehicle body.

19. The track travelling device according to claim 1, further comprising a detection device mounted on the vehicle body to detect connection states of components on the vehicle body, the connection device and the wheels.

* * * * *